United States Patent [19]

Schmidt

[11] 3,938,964

[45] Feb. 17, 1976

[54] BERYLLIUM REINFORCED COMPOSITE SOLID AND HOLLOW SHAFTING

[75] Inventor: Richard Schmidt, Mclean, Va.

[73] Assignee: The United States of America as represented by the Secretary of the Navy, Washington, D.C.

[22] Filed: Mar. 18, 1974

[21] Appl. No.: 452,156

Related U.S. Application Data

[62] Division of Ser. No. 256,491, May 24, 1972.

[52] U.S. Cl. ..... 29/191.4

[51] Int. Cl.[2] ..... B32B 15/02

[58] Field of Search ..... 29/191, 191.6, 191.4, 256, 29/491; 148/4

[56] References Cited

UNITED STATES PATENTS

| | | | |
|---|---|---|---|
| 1,125,161 | 1/1915 | Page | 29/191.4 |
| 1,280,909 | 10/1918 | Wales et al. | 29/191.4 X |
| 1,292,659 | 1/1919 | Speed | 29/191.4 |
| 1,628,759 | 5/1927 | Worrall | 29/191.4 |
| 3,419,952 | 1/1969 | Carlson | 29/471.3 |
| 3,609,855 | 10/1971 | Schmidt | 29/191 X |

*Primary Examiner*—Allen B. Curtis

*Attorney, Agent, or Firm*—R. S. Sciascia; R. F. Beers; P. Schneider

[57] ABSTRACT

A solid or hollow shaft has an aluminum or titanium matrix reinforced with arcuate-shaped beryllium ribbons arranged around a central rod or core to form a circular cross-sectional configuration. The shaft has a high degree of torsional stiffness which enables it to be used on advanced aircraft or high-speed rotating machinery without mid-support bearings. The shaft may be formed by cladding the beryllium rods in aluminum or titanium and arranging them around the central rod or core to form a preform with a circular cross-sectional configuration. The preform is then subjected to hydrostatic pressure, causing the beryllium rods to deform into arcuate-shaped ribbons. The core may then be retained or leached out to provide a hollow shaft.

6 Claims, 6 Drawing Figures

BERYLLIUM REINFORCED COMPOSITE SOLID AND HOLLOW SHAFTING

This application is a division of my copending application, Ser. No. 256,491 filed 24 May 1972.

BACKGROUND OF THE INVENTION

Shafts are probably one of the oldest structural elements known to man, in the form of a long slender rod forming the body of a spear, the handle of a hammer, ax or golf club, and many other long implements. Modern aircraft use shafts to transmit motion, such as control rods. Most machinery use shafts to transmit motion in a push-pull or rotating action.

The major shortcoming of shafting used in advanced aircraft or high-speed rotating machinery is a low modulus of elasticity to density (stiffness to weight) ratio. This poor stiffness to weight ratio requires the use of mid-support bearings or other mechanical devices which greatly increase weight, waste power and complicate design. One method of increasing the modulus and reducing the weight of a metal shaft is to reinforce it with a higher modulus and lower density material. Another characteristic necessary for the reinforcement is ductility sufficient for redistribution of stresses.

Many shafts are subject to impact loading, for example, connecting rods in a reciprocating engine, transmission shafts in a helicopter, and control rods in an aircraft. Previous work has proven that the metal beryllium used as a reinforcement in a metal matrix composite is superior to all other plastic and metal matrix composites when subject to impact loads. The lack of ductility has proven to be a serious limitation in boron aluminum, boron epoxy and carbon epoxy type composites. In addition, the excellent elevated temperature ductility of beryllium allows fabrication procedures to be employed which could not be considered for less ductile composite systems.

Others have employed beryllium fiber, filaments and wires as reinforcing material. The diameter of this wire has not exceeded 0.01 inches and is quite costly to make, almost $4,000per pound. In my previous U.S. Pat. No. 3,609,855 and U.S. Pat. No. 3,667,108 and in my parent application Ser. No. 256,491, methods and techniques for the production of beryllium ribbon-reinforced composites and beryllium-titanium blading were disclosed. This invention is related to those methods but instead is directed to hollow and solid composite shafting.

SUMMARY OF THE INVENTION

There are several manufacturing processes that can be utilized to end up with the required properties for a composite beryllium-aluminum or beryllium-titanium shaft. The important considerations are: (1) volume fraction of the beryllium reinforcement; (2) size and shape of the reinforcement; (3) the mechanical properties of both the beryllium and the aluminum or titanium matrix after the fabrication of the shaft; and (4) the bond strength and degree of reaction (alloying) between the beryllium and the aluminum or titanium matrix. The present invention has been developed with these considerations in mind.

The invention consists of a shaft having a matrix of aluminum or titanium and a plurality of arcuate-shaped ribbons of beryllium disposed around a central rod or core. The beryllium ribbons define a circular cross-sectional pattern and may additionally define a plurality of concentric cylinders arranged around the central rod or core.

The centers of the concentric circles preferably coincide with the center of the shaft.

OBJECTS OF THE INVENTION

An object is to provide a shaft with a relatively high modulus of elasticity to density ratio.

A further object of the invention is the provision of a shaft what will eliminate the need for mid-support bearings in advanced aircraft or high speed rotating machinery.

Other objects, advantages, and novel features of the present invention will become apparent from the following detailed description of the invention when considered in conjunction with the accompanying drawings.

DETAILED DESCRIPTION OF THE PREFERRED EMBODIMENTS

Figure 5:
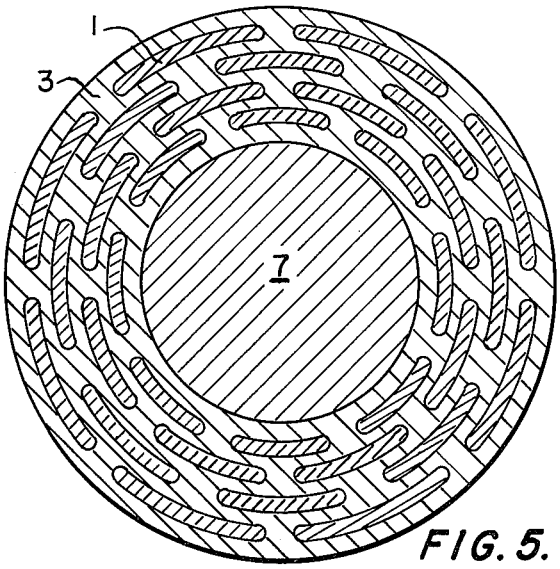
Figure 6:
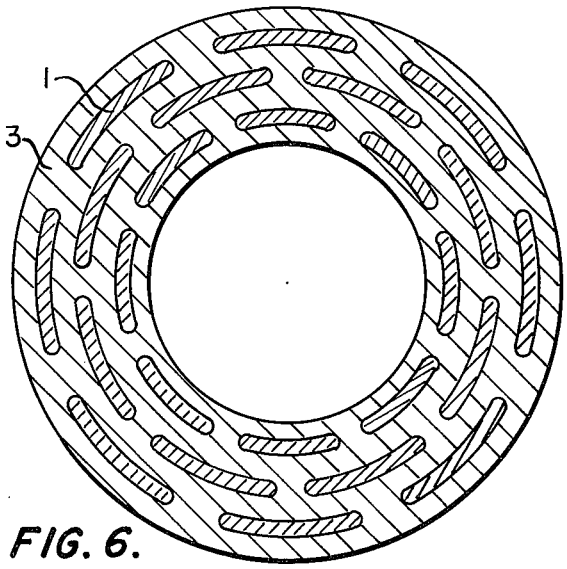
FIG. 6 shows a cross-section of an enlarged completed hollow shaft in accordance with the invention.

The composite shaft of the invention as shown in FIGS. 5 and 6 includes a plurality of beryllium reinforcements and a matrix of titanium or aluminum 3. The reinforcements 1 of the completed shaft shown in FIGS. 5 and 6 have an arcuate ribbon-shape congruent with the contour of the shaft. The ribbons may form a plurality of concentric cylinders surrounding the central rod or core. The shaft of FIG. 5 includes a central rod or center section 7 which may be beryllium. In an additional embodiment, the shaft of FIG. 6 includes a hollow core or center section. The shaft of the invention may be made by a number of processes, however one process in particular will be described herein.

The first step in the process involves the production of beryllium rods having a diameter of ⅛ inch or greater either by extrusion, drawing, swagging, rolling or machining from blocks. The beryllium rods 1 are then clad with aluminum or titanium 3. The cladding may be accomplished by many methods, such as slipping the rods into tubing, stuffing the rods into powder or into a block full of evenly spaced holes, wrapping sheet or foil around the beryllium, vapor depositing or electroplating.

Figure 1:
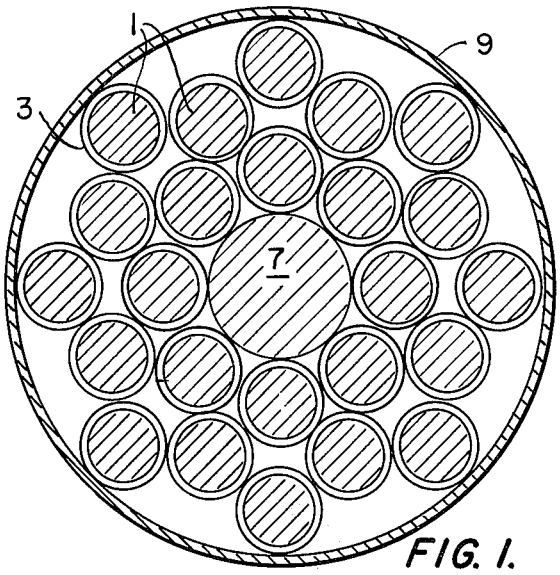
FIGS. 1 and 2 show in cross-section a bundled preform of the invention.
Figure 2:
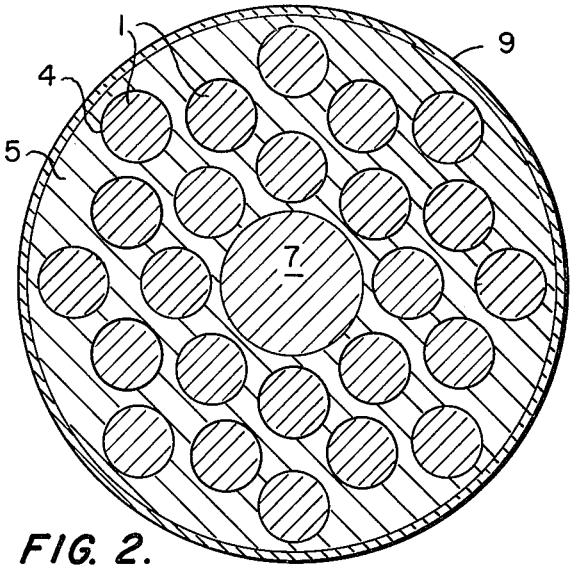

The next step is to bundle the clad beryllium rods into a configuration similar to FIG. 1. Another method of placement of the beryllium is to accurately drill holes 4 into an aluminum or titanium block 5 as shown in FIG. 2. The volume fraction of the beryllium reinforcement is controlled by the thickness of the cladding as shown in FIG. 1 or by the spacing of the drilled holes as shown in FIG. 2. The preform for solid shafting should utilize a beryllium center section 7 for minimum weight. The preform for hollow shafting can have a hollow center or a solid center of a material which can be leached out later in the manufacturing process. In the embodiments of FIGS. 1 and 2, the axes of the beryllium rods 1 define a plurality of concentric cylinders surrounding the center rod 7.

After the bundle has been formed it is heated to a temperature for consolidation of the preform. Particularly in the case of an aluminum matrix, most of the deformation will occur in the aluminum, unless hydrostatic pressures are maintained. Cladding the preform in a steel can will provide this hydrostatic pressure. The steel can 9 will also prove useful, since it will prevent galling between the titanium and the steel die (not shown).

Figure 3:
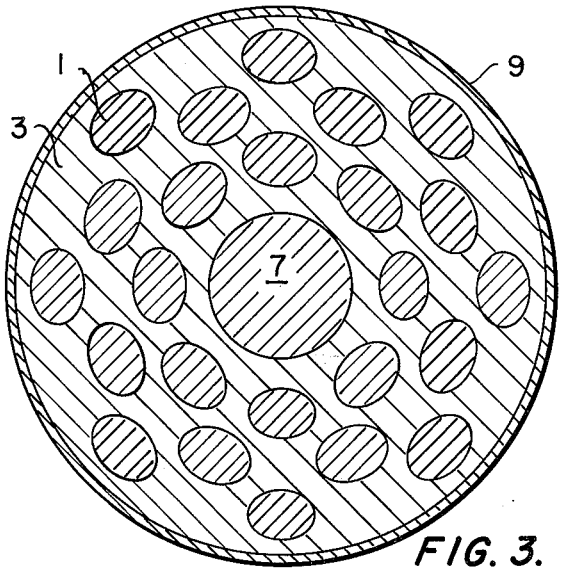
FIGS. 3, 4 and 5 show enlarged cross-sections of the preform at various stages of the process of deformation.
Figure 4:
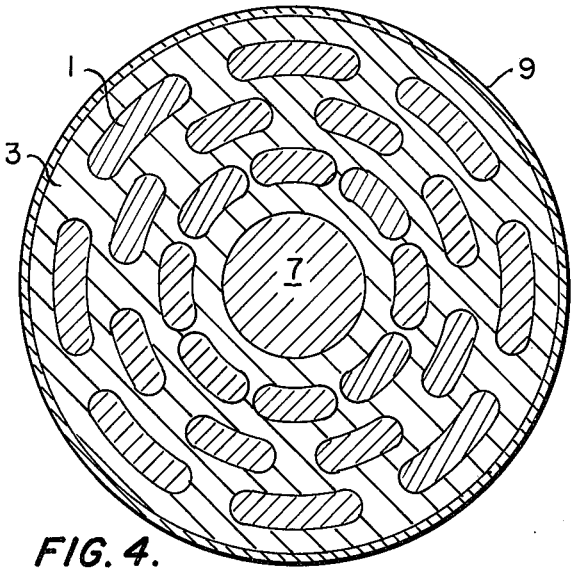

The reduction of this preform to a shaft is accomplished by a series of controlled metallurgical deformation processes. Reduction can be accomplished by extrusion, swagging, drawing or rolling. The important factor is to control the flow pattern of the beryllium. FIGS. 3, 4 and 5 illustrate the shaft at various points in this reduction process. The fact that beryllium is a ductile reinforcement enables one to form the composite into a complex shape either during the initial fabrication or after the composite shaft is made. It is only necessary to heat the composite to a temperature at which the shear strength of the matrix or reinforcement matrix bond is very low, permitting the reinforcement to bend and the matrix to flow around the reinforcement. Application of pressure on the outer surface of the steel can 9 produces uniform exterior pressure on the outer surfaces of the clad beryllium rods while the round mandrel 7 applies interior pressure against the inner surfaces of the clad rods, causing them to assume the final arcuate shape shown in enlarged finished products of FIGS. 5 and 6. The steel can 9 is shown removed in FIGS. 5 and 6.

Rotating shafts require torsional stiffness. An arcuate ribbon-reinforced shaft as shown in FIGS. 5 and 6 has been found to be most efficient for this purpose, the arcuate ribbons defining a plurality of concentric cylinders surrounding the center rod 7. The radii of the various arcuate ribbons preferably start at the center of the shaft, as shown in FIGS. 5 and 6. The final shape of the reinforcement will depend on the initial shape of the reinforcement and the direction and amount of deformation. In the shaft shown in FIGS. 5 and 6, the arcuate reinforcing ribbons forming any one concentric circle overlap in arcuate width the arcuate ribbons and interjacent matrix material of adjacent concentric circles. The arcuate ribbon-shaped reinforcement is highly desirable.

Hollow shafting as shown in FIG. 6 may be formed over a mandrel as in conventional drawing or swagging operations. In the alternative, the solid center can be leached out with a suitable acid. It should be noted that other distribution patterns for the arcuate beryllium ribbon are possible.

For a shafting application, the volume fraction of the beryllium reinforcement should be between 25 and 85 percent. Less than 25 percent would not give sufficient reinforcement and over 85 percent would result in a brittle composite shaft. A good balance between stiffness and toughness would be about 50 percent. For optimum strength and fracture toughness, the resultant size of the beryllium reinforcement should be as small as economically practical. A good rule of thumb is to provide a minimum of three layers of reinforcement for good impact resistance. The fabrication temperature for aluminum should be between 600° to 800° Fahrenheit and 1200° to 1400° Fahrenheit for titanium to minimize the loss in strength of the beryllium and the reaction between the beryllium and the matrix.

Obviously many modifications and variations of the present invention are possible in light of the above teachings. It is therefore to be understood that, within the scope of the appended claims, the invention may be practiced otherwise than as specifically described.

What is claimed is:

1. A beryllium reinforced metal shaft comprising:
a plurality of arcuate, beryllium reinforcing ribbons imbedded in a metal matrix;
said metal matrix being selected from the group consisting of aluminum and titanium;
said arcuate, beryllium reinforcing ribbons arranged in said matrix to coincide with concentric circles whose centers coincide with the cent of the shaft,
substantially each arcuate ribbon in any one circle overlapping in arcute width an arcuate ribbon in another circle with matrix material therebetween.

2. The shaft of claim 1 having a central portion wherein the central portion is hollow.

3. A beryllium-reinforced metal shaft comprising:
a plurality of arcuate, beryllium ribbons imbedded in a metal matrix and arranged around the longitudinal axis of the shaft to define a circular cross-section;
said metal matrix being selected from the group consisting of aluminum and titanium;
said shaft having a central portion which is a solid rod of beryllium.

4. A beryllium-reinforced metal shaft comprising:
a plurality of arcuate, beryllium reinforcing ribbons imbedded in a metal matrix;
said metal matrix being selected from the group consisting of aluminum and titanium;
said arcuate, beryllium reinforcing ribbons arranged in said matrix to coincide with concentric circles whose centers coincide with the center of the shaft, said shaft having a central portion which is a solid rod of beryllium.

5. A beryllium-reinforced metal shaft designed for use in rotating machinery, or as a control rod, without the need for mid-support bearings, comprising:
a plurality of arcuate, beryllium reinforcing ribbons imbedded in a metal matrix;
said metal matrix being selected from the group consisting of aluminum and titanium;
the radius of curvature of said arcuate, beryllium reinforcing ribbons arranged in said matrix being substantially the same as that of said shaft thereby to coincide with the center of the shaft, the central portion of said shaft being hollow.

6. A beryllium-reinforced metal shaft comprising:
a plurality of arcuate, beryllium reinforcing ribbons imbedded in a metal matrix, there being matrix material between adjacent arcuate ribbons,
said metal matrix being selected from the group consisting of aluminum and titanium,
the width of substantially each arcuate ribbon overlapping a portion of the width of an adjacent arcuate ribbon above or below it in radial direction from the center of said shaft.

* * * * *